US006419586B1

(12) United States Patent
Chiu

(10) Patent No.: US 6,419,586 B1
(45) Date of Patent: Jul. 16, 2002

(54) MULTI-FUNCTIONAL BALANCE ROTARY DISK

(76) Inventor: I-Cheng Chiu, 9F, No. 70 Sec. 5, Nan-King Road, Taipei (TW)

( * ) Notice: Subject to any disclaimer, the term of this patent is extended or adjusted under 35 U.S.C. 154(b) by 0 days.

(21) Appl. No.: 09/774,771

(22) Filed: Jan. 30, 2001

(51) Int. Cl.[7] ..... A63G 1/20
(52) U.S. Cl. ..... 472/25; 472/26; 472/135
(58) Field of Search ..... 472/14, 15, 21, 472/22, 23, 24, 25, 26, 16, 135; 482/146

(56) References Cited

U.S. PATENT DOCUMENTS 1,357,940 A * 11/1920 Berry ..... 220/642
3,604,722 A * 9/1971 Boley ..... 280/87.01
3,862,768 A * 1/1975 England ..... 280/205
4,605,224 A * 8/1986 Torii ..... 482/146
4,613,131 A * 9/1986 Anderson ..... 482/146
6,019,712 A * 2/2000 Duncan ..... 482/110

* cited by examiner

*Primary Examiner*—Kien T. Nguyen
(74) *Attorney, Agent, or Firm*—Pro-Techtor Internatioal Services

(57) ABSTRACT

The present invention relates to a multi-functional balance rotary disk includes a circular disk body having a center provided with a circular base. The circular base is recessed to form a plurality of successive tracks, so that a ball can roll in the tracks. The disk body has a bottom formed with an arc-shaped face for allowing rotation of the disk body. A plurality of holding handles are secured on comers of the disk body, for allowing hold of a user. The child may stand on the disk body for training balance of his hands, while the child can use swinging action of his feet to swing the disk body, whereby the ball continuously rolls in the tracks so that the child can watch the rolling ball for training his eyes. The disk body can also function as a skateboard or a swing.

5 Claims, 11 Drawing Sheets

MULTI-FUNCTIONAL BALANCE ROTARY DISK

BACKGROUND OF THE INVENTION

1. Field of the Invention

The present invention relates to a multi-functional balance rotary disk, and more particularly to a multi-functional balance rotary disk that can be used to perform the exercise of balance, rotation etc., and can also be used to function as a skateboard or a swing.

2. Description of the Related Prior Art

A conventional playing toy in accordance with the prior art only is limited by its design of structure, therefore, it has a single function only, and cannot be adapted to have dual functions or multi-functions, such that the conventional playing toy lacks variations and amusement, thereby greatly limiting the versatility of the conventional playing toy. For example, the rotary disk can be used to rotate only, the balance board can be used to train the player's balance only, and the rolling ball disk can be used to roll the balls only, so that they cannot afford the additive value of the products.

SUMMARY OF THE INVENTION

The present invention has arisen to mitigate and/or obviate the disadvantage of the conventional playing toy.

The primary objective of the present invention is to provide a multi-functional balance rotary disk that can be used to train the balance of the child's hands and eyes.

Another objective of the present invention is to provide a multi-functional balance rotary disk that has different ball rolling tracks, thereby increasing the amusement and difficulty of playing the rotary disk.

A further objective of the present invention is to provide a multi-functional balance rotary disk that may function as a skateboard.

A further objective of the present invention is to provide a multi-functional balance rotary disk that may function as a swing.

In accordance with one aspect of the present invention, there is provided a multi-functional balance rotary disk comprising:

a disk body having a center provided with a circular base, the circular base being recessed to form a plurality of successive tracks, a ball rolling in the tracks, the disk body having a bottom formed with an arc-shaped face for allowing rotation of the disk body, a plurality of holding handles secured on the disk body, for driving the disk body to rotate, thereby forming a playing apparatus having a balance ball and a rotary disk body.

In accordance with another aspect of the present invention, there is provided a multi-functional balance rotary disk includes a circular disk body having a center provided with a circular base. The circular base is recessed to form a plurality of successive tracks, so that a ball can roll in the tracks. The disk body has a bottom formed with an arc-shaped face for allowing rotation of the disk body. A plurality of holding handles are secured on corners of the disk body, for allowing hold of a user. The child may stand on the disk body for training balance of his hands, while the child can use swinging action of his feet to swing the disk body, whereby the ball continuously rolls in the tracks so that the child can watch the rolling ball for training his eyes. A transparent circular cover may be mounted in the circular base of the disk body, thereby preventing the ball rolling in the tracks from rolling outward from the disk body. A rolling ball seat having different tracks may be mounted in the circular base of the disk body, thereby changing rolling tracks of the ball. A circular pad may be inserted in the circular base of the disk body, so that a child can squat on the circular pad. Each of the holding handles secured on the bottom of the disk body has an inner side provided with a rotation roller, so that the disk body can function as a skateboard. The disk body has a periphery defining a plurality of through holes each inserted with a plug which can be removed from the through hole whereby ropes can pass through the through holes to be fastened, so that the disk body can function as a bottom board of a swing.

Further benefits and advantages of the present invention will become apparent after a careful reading of the detailed description with appropriate reference to the accompanying drawings.

DETAILED DESCRIPTION OF THE INVENTION

Figure 1:
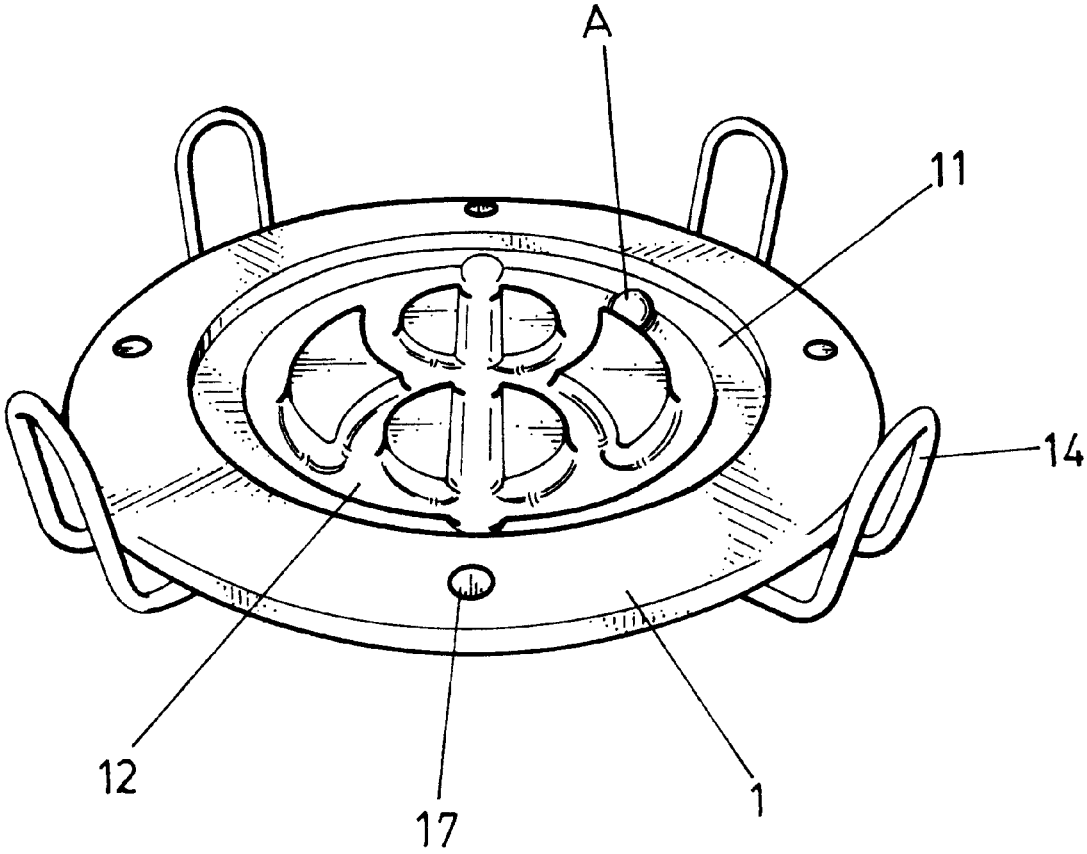
FIG. 1 is a perspective view of a multi-functional balance rotary disk in accordance with an embodiment of the present invention.
Figure 2:
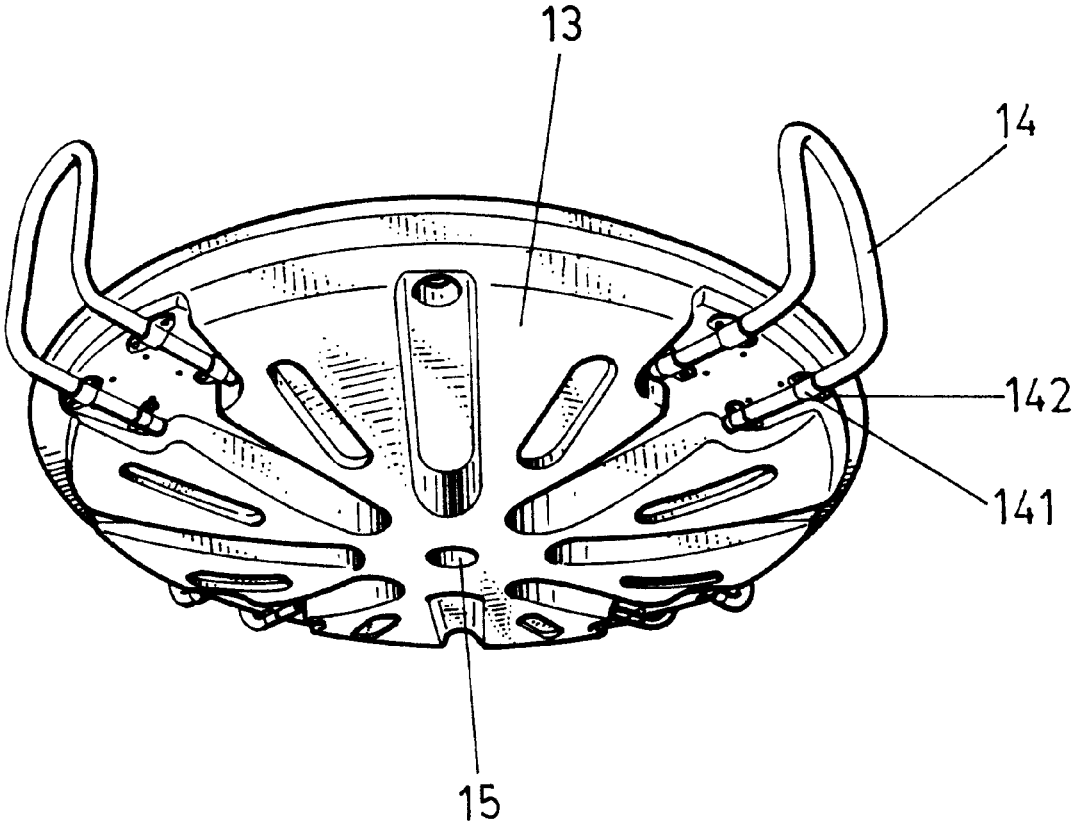
FIG. 2 is a bottom perspective view of the multi-functional balance rotary disk as shown in FIG. 1.

Referring to the drawings and initially to FIGS. 1 and 2, a multi-functional balance rotary disk in accordance with an embodiment of the present invention comprises a disk body 1 having a center provided with a circular base 11. The circular base 11 is recessed to form a plurality of arc shaped successive tracks 12, so that a ball A may be placed in the tracks 12 to roll in the tracks 12. The disk body 1 has a bottom formed with an arc-shaped face 13 as shown in FIG. 2 for allowing rotation of the disk body 1 by the design of the arc-shaped face 13. The four corners of the disk body 1 are respectively secured with a holding handle 14 which is a substantially L-shaped dual-rod handle. The holding handle 14 on the bottom arc-shaped face 13 is secured on the disk body 1 by fixing pieces 141 and screws 142, whereby the user can drive the holding handle 14 to rotate the disk body 1, thereby forming a playing apparatus having a balance ball and a rotary disk body.

Figure 3:
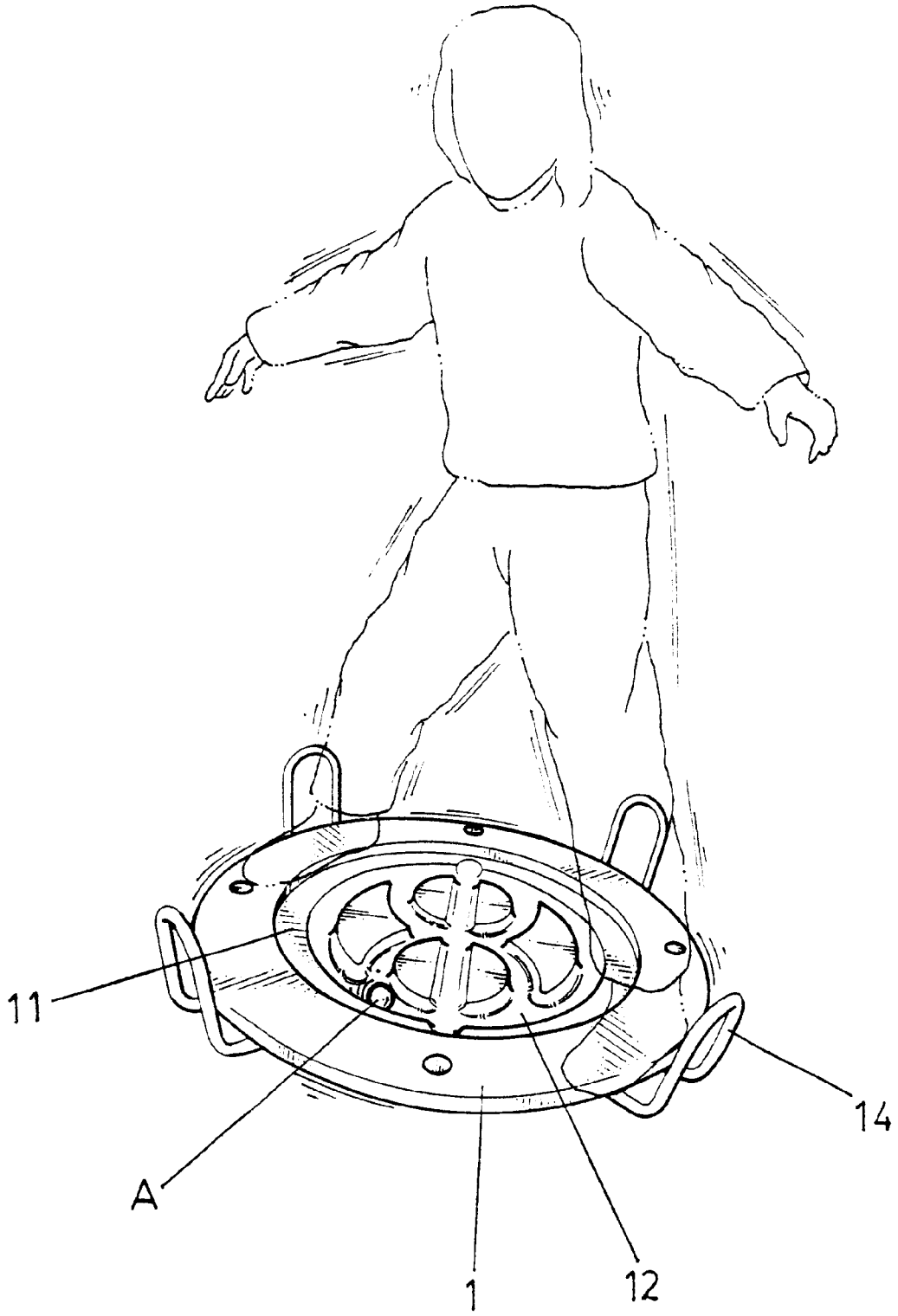
FIG. 3 is a schematic operational view of the multi-functional balance rotary disk as shown in FIG. 1.

Referring to FIG. 3, the child standing on the disk body 1 can swing his two feet to swing the disk body 1 in an inclined manner, so that the ball A continuously rolls in the tracks 12, thereby training the balance of the child's hands and eyes.

Figure 4:
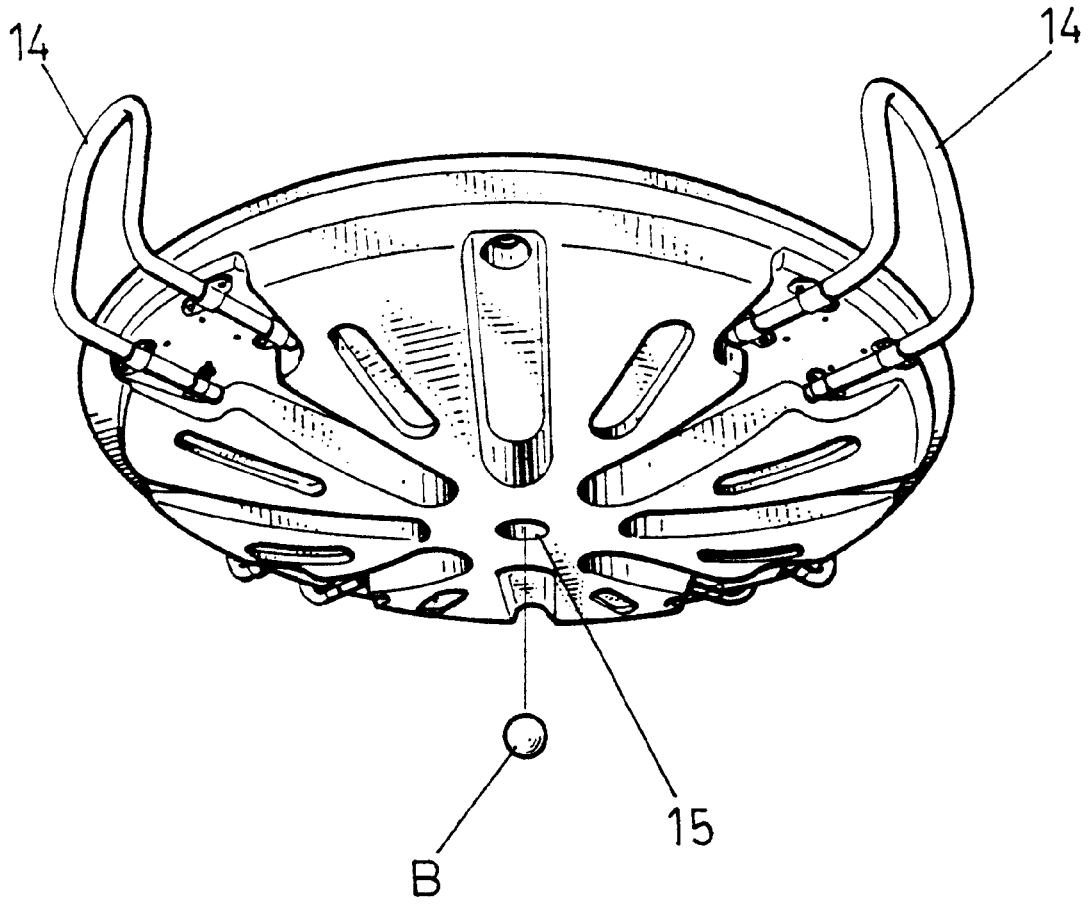
FIG. 4 is a bottom perspective view of another embodiment of the multi-functional balance rotary disk as shown in FIG. 1.

Referring to FIG. 4, for increasing the oscillation amplitude and the excitement of the disk body 1, the bottom of the disk body 1 defines a circular recess 15 having one side opening for allowing insertion of a ball B, and part of the ball B protrudes and exposes outward from the circular recess 15, thereby increasing the softness and difficulty of playing the disk body 1.

Figure 5:
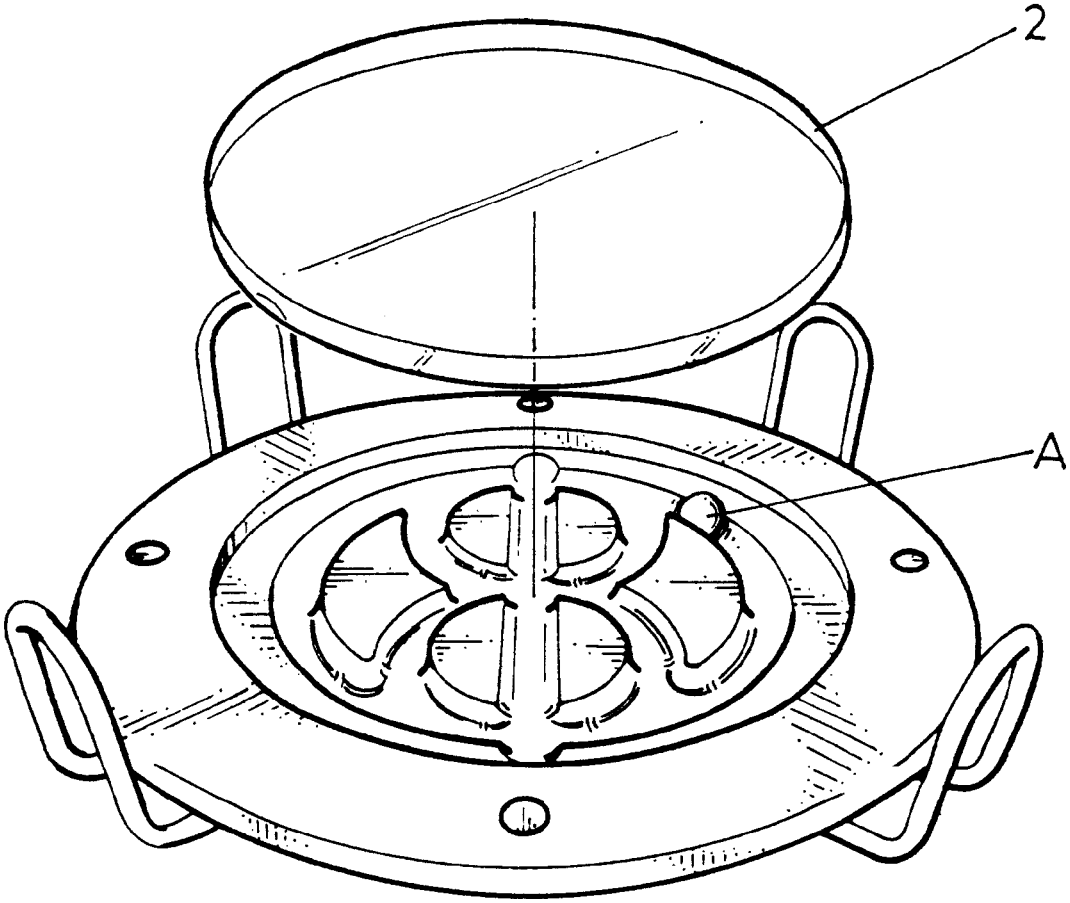
FIG. 5 is a perspective view of a multi-functional balance rotary disk in accordance with a further embodiment of the present invention.

Referring to FIG. 5, a transparent circular cover 2 is mounted in the circular base 11 of the disk body 1, thereby preventing the ball A rolling in the tracks 12 from rolling outward from the disk body 1, without affecting rolling of the ball A.

Figure 6:
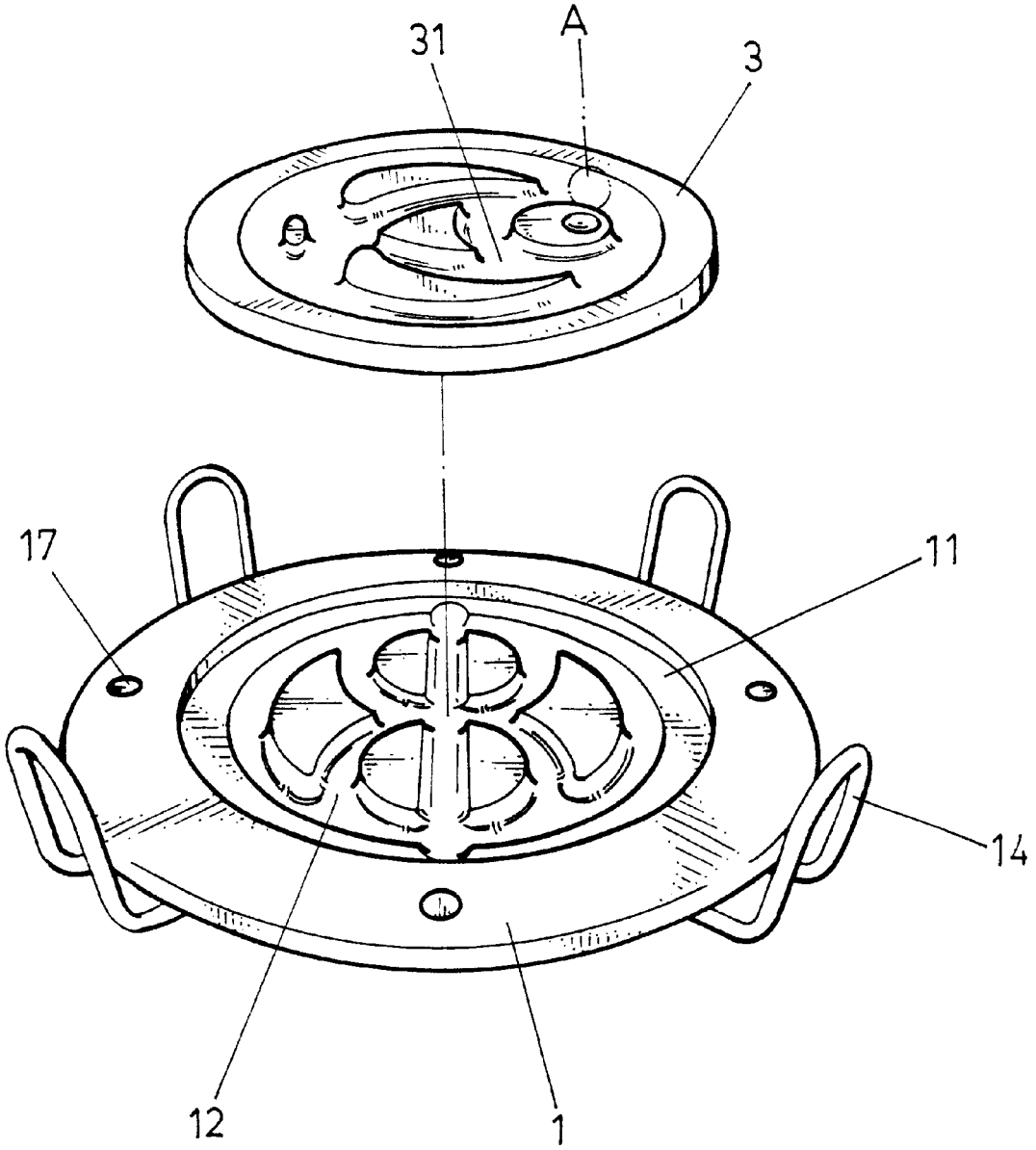
FIG. 6 is a perspective view of a multi-functional balance rotary disk in accordance with a further embodiment of the present invention.

Referring to FIG. 6, a rolling ball seat 3 having another different track is mounted in the circular base 11 of the disk body 1, and can be used to change the path of the track 31, so that the rolling ball seat 3 can change the different track 31 arbitrarily, thereby increasing the amusement and difficulty of playing the disk body 1.

Figure 7:
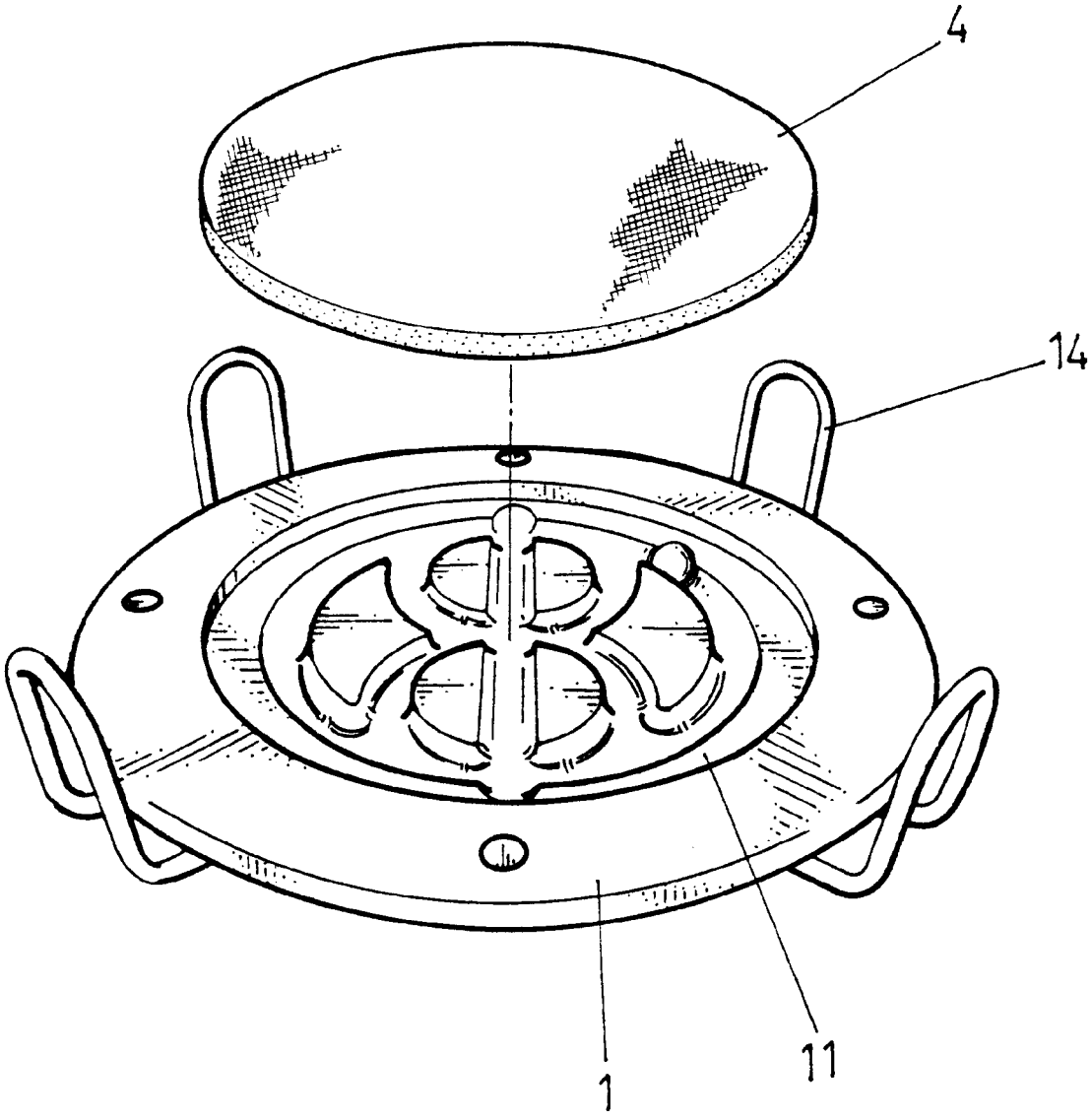
FIG. 7 is a perspective view of a multi-functional balance rotary disk in accordance with a further embodiment of the present invention.

Referring to FIG. 7, a circular pad 4 made of soft material is inserted in the circular base 11 of the disk body 1, so that a child can squat on the circular pad 4, whereby another child may drive the holding handle 14 to rotate the disk body 1, thereby achieving a rotation playing effect.

Figure 8:
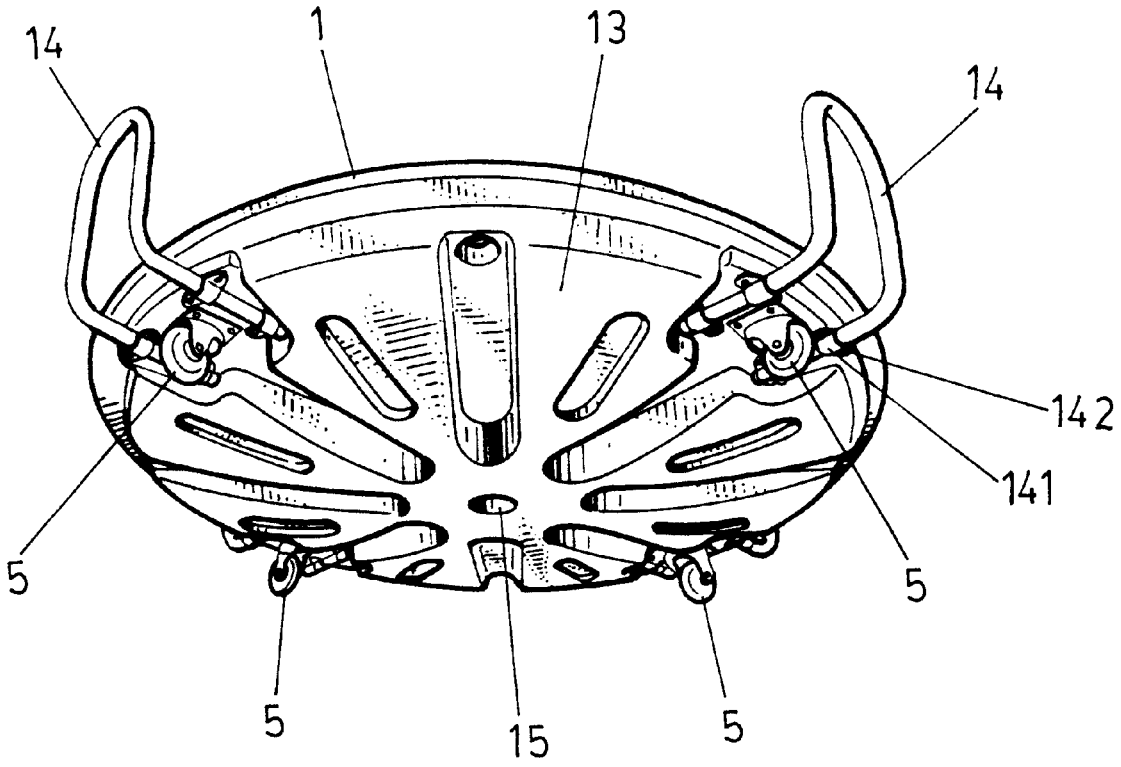
FIG. 8 is a bottom perspective view of a multi-functional balance rotary disk in accordance with a further embodiment of the present invention.

Referring to FIG. 8, each of the four holding handles 14 secured on the bottom of the disk body 1 has an inner side provided with a rotation roller 5 by bolts, so that the disk body 1 functions as a skateboard.

Figure 9:
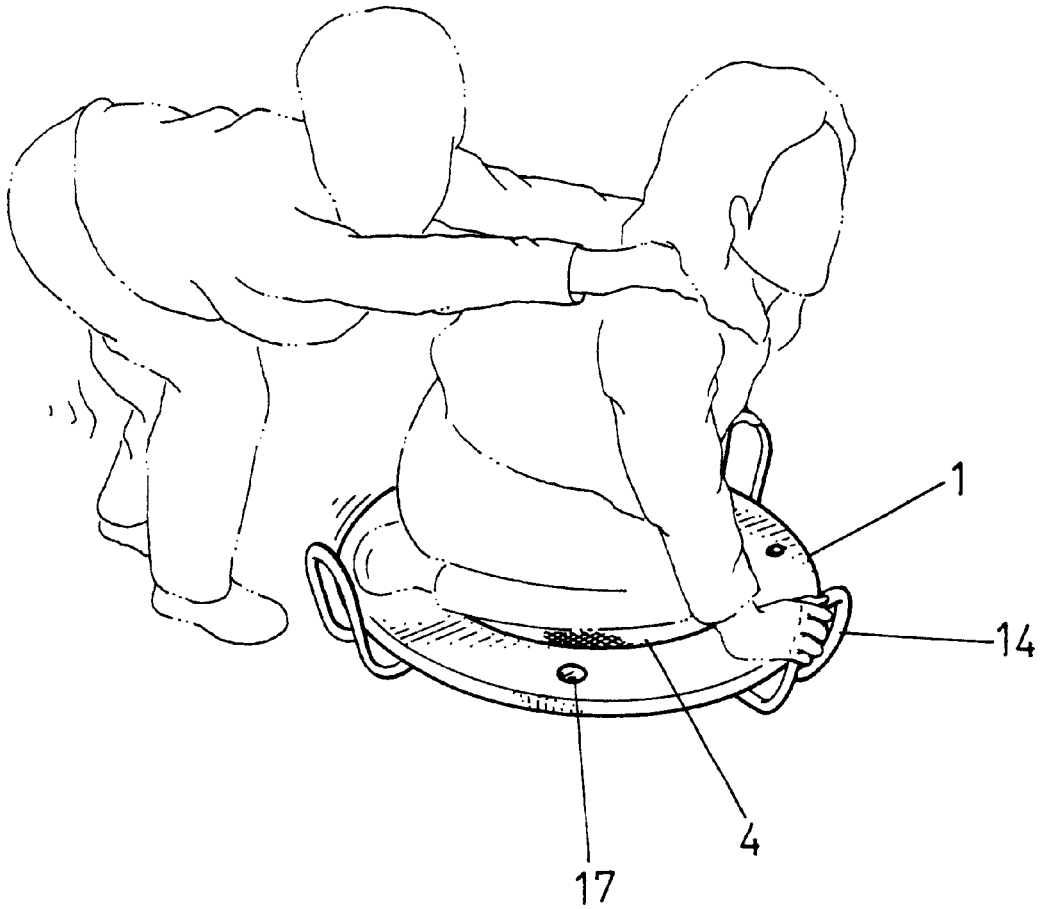
FIG. 9 is a schematic operational view of the multi-functional balance rotary disk as shown in FIG. 8.

Referring to FIG. 9, the child can sit or squat on the circular pad 4 of the disk body 1 with his hands holding the holding handles 14, while another child may push the back of the squatting child, so as to move the disk body 1 which functions as a skateboard.

Figure 10:
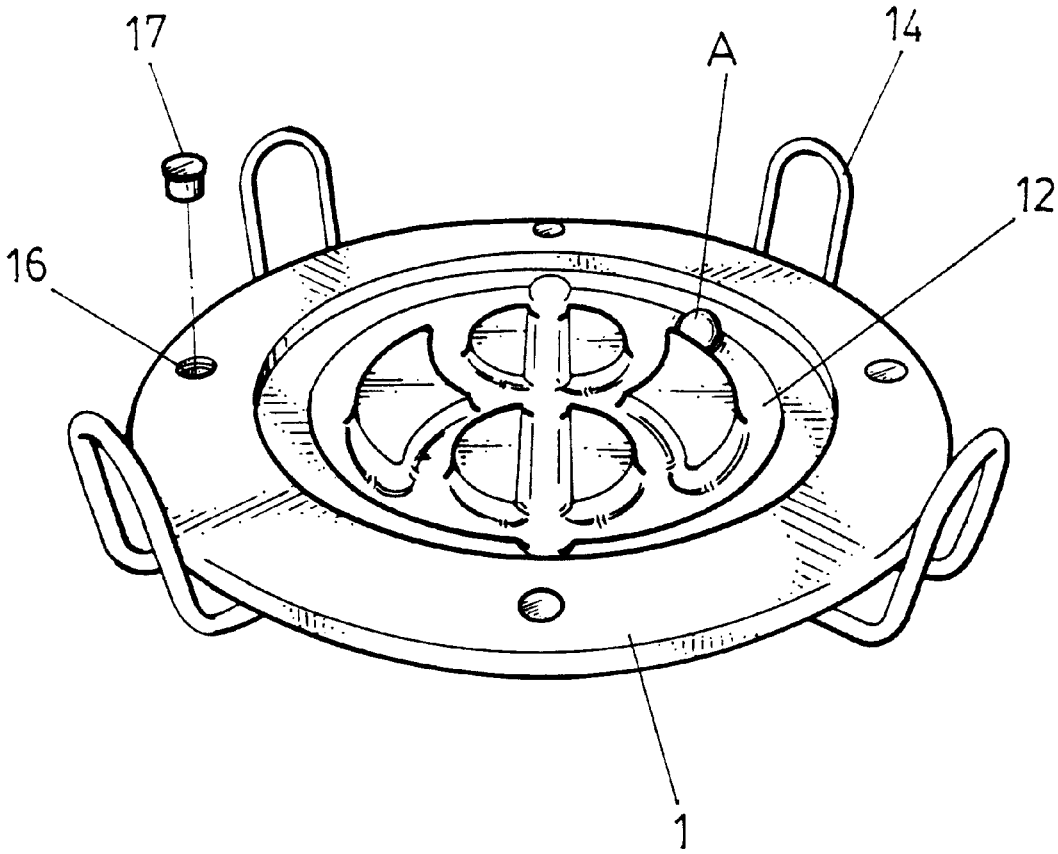
FIG. 10 is a bottom perspective view of a multi-functional balance rotary disk in accordance with a further embodiment of the present invention.
Figure 11:
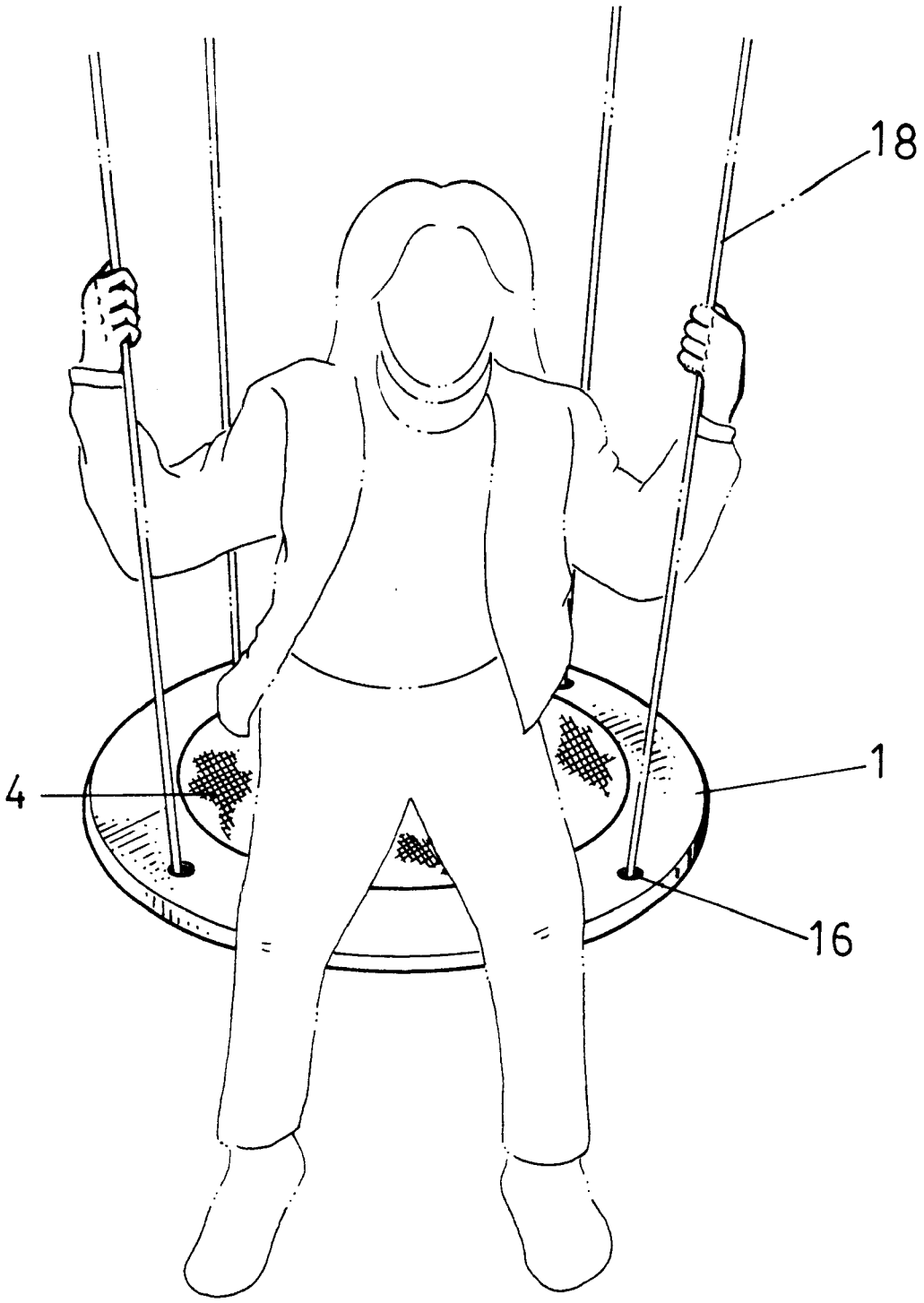
FIG. 11 is a schematic operational view of the multi-functional balance rotary disk as shown in FIG. 10.

Referring to FIGS. 10 and 11, the disk body 1 has a periphery defining four through holes 16 each inserted with a plug 17 which can be removed from the through hole 16 whereby ropes 18 can pass through the through holes 16 to be fastened, so that the disk body 1 can function as the bottom board of a swing.

Although the invention has been explained in relation to its preferred embodiment as mentioned above, it is to be understood that many other possible modifications and variations can be made without departing from the scope of the present invention. It is, therefore, contemplated that the appended claims will cover such modifications and variations that fall within the true scope of the invention.

What is claimed is:

1. A multi-functional balance rotary disk comprising:

a disk body having a central circular base section, said circular base section being recessed and including therein a plurality of tracks that receive a ball, said disk body having a convex bottom side with a plurality of holding handles secured thereon to assist a user in rotating said disk body, said rotary disk thereby forming a playing apparatus having a balance ball and a rotary disk body, wherein said bottom side of said disk body includes a circular recess adapted to receive a ball.

2. A multi-functional balance rotary disk comprising:

a disk body having a central circular base section, said circular base section being recessed and including therein a plurality of tracks that receive a ball, said disk body having a convex bottom side with a plurality of holding handles secured thereon to assist a user in rotating said disk body, said rotary disk thereby forming a playing apparatus having a balance ball and a rotary disk body, wherein said circular base section removably receives a rolling ball seat that changes a pattern of said tracks that receive said ball.

3. A multi-functional balance rotary disk comprising:

a disk body having a central circular base section, said circular base section being recessed and including therein a plurality of tracks that receive a ball, said disk body having a convex bottom side with a plurality of holding handles secured thereon to assist a user in rotating said disk body, said rotary disk thereby forming a playing apparatus having a balance ball and a rotary disk body, thereby forming a playing apparatus having a balance ball and a rotary disk body, wherein a circular pad is inserted into said circular base section of said disk body so that a child can squat on said circular pad.

4. A multi-functional balance rotary disk comprising:

a disk body having a central circular base section, said circular base section being recessed and including therein a plurality of tracks that receive a ball, said disk body having a convex bottom side with a plurality of holding handles secured thereon to assist a user in rotating said disk body, said rotary disk thereby forming a playing apparatus having a balance ball and a rotary disk body, wherein each of said holding handles secured has an inner side provided with a rotation roller, so that said disk body is adapted to function as a skateboard.

5. A multi-functional balance rotary disk comprising:

a disk body having a central circular base section, said circular base section being recessed and including therein a plurality of tracks that receive a ball, said disk body having a convex bottom side with a plurality of holding handles secured thereon to assist a user in rotating said disk body, said rotary disk thereby forming a playing apparatus having a balance ball and a rotary disk body, wherein a periphery of said disk body includes a plurality of through holes, each said through hole receiving a removable plug, said through holes receiving ropes when said plugs are removed, so that said disk body is adapted to function as a bottom board of a swing.

* * * * *